US009834835B2

(12) United States Patent
Strock et al.

(10) Patent No.: US 9,834,835 B2
(45) Date of Patent: Dec. 5, 2017

(54) FIRE CONTAINMENT COATING SYSTEM FOR TITANIUM

(71) Applicant: United Technologies Corporation, Hartford, CT (US)

(72) Inventors: Christopher W. Strock, Kennebunk, ME (US); Matthew E. Bintz, West Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 333 days.

(21) Appl. No.: 14/624,817

(22) Filed: Feb. 18, 2015

(65) Prior Publication Data

US 2016/0362774 A1 Dec. 15, 2016

(51) Int. Cl.

| | |
|---|---|
| ***C23C 4/02*** | (2006.01) |
| ***C22C 27/02*** | (2006.01) |
| ***C22C 27/04*** | (2006.01) |
| ***C22C 27/06*** | (2006.01) |
| ***C23C 4/10*** | (2016.01) |
| ***C23C 4/14*** | (2016.01) |
| ***F04D 29/02*** | (2006.01) |
| ***F04D 29/16*** | (2006.01) |

(Continued)

(52) U.S. Cl.

CPC ..... *C23C 4/02* (2013.01); *C22C 27/025* (2013.01); *C22C 27/04* (2013.01); *C22C 27/06* (2013.01); *C23C 4/11* (2016.01); *C23C 4/134* (2016.01); *C23C 28/321* (2013.01); *C23C 28/347* (2013.01); *C23C 28/3455* (2013.01); *F01D 5/288* (2013.01); *F01D 11/122* (2013.01); *F04D 29/023* (2013.01); *F04D 29/164* (2013.01); *F04D 29/321* (2013.01); *F04D 29/526* (2013.01); *F05D 2230/312* (2013.01); *F05D 2240/11* (2013.01); *F05D 2300/174* (2013.01); *F05D 2300/2118* (2013.01)

(58) Field of Classification Search

CPC ..... F01D 11/12; F01D 25/14; C23C 28/00; C23C 4/02; C23C 4/11; C22C 27/02; C22C 27/04; C22C 27/06

See application file for complete search history.

(56) References Cited

U.S. PATENT DOCUMENTS 4,761,346 A * 8/1988 Naik ..... C23C 28/00 428/627
5,006,419 A * 4/1991 Grunke ..... C23C 22/74 428/623

(Continued)

FOREIGN PATENT DOCUMENTS

DE 102007005755 A1 8/2008
EP 2112248 A1 10/2009

(Continued)

OTHER PUBLICATIONS

European Search Report for EP Patent Application No. 16153869.9, dated Jun. 15, 2016.

*Primary Examiner* — Igor Kershteyn

(74) *Attorney, Agent, or Firm* — Bachman & LaPointe, P.C.

(57) ABSTRACT

A coated substrate comprises: a metallic substrate; a bondcoat atop the substrate; and a ceramic barrier coat atop the bondcoat. The bondcoat has a combined content of one or more of molybdenum, chromium, and vanadium of at least 50 percent by weight.

23 Claims, 3 Drawing Sheets

(51) Int. Cl.

| | |
|---|---|
| ***F04D 29/32*** | (2006.01) |
| ***F04D 29/52*** | (2006.01) |
| ***C23C 28/00*** | (2006.01) |
| ***F01D 11/12*** | (2006.01) |
| ***C23C 4/11*** | (2016.01) |
| ***C23C 4/134*** | (2016.01) |
| ***F01D 5/28*** | (2006.01) |

(56) References Cited

U.S. PATENT DOCUMENTS

| | | | | |
|---|---|---|---|---|
| 5,114,797 | A * | 5/1992 | Uihlen | B32B 15/01 428/552 |
| 5,413,871 | A * | 5/1995 | Nelson | C23C 4/02 419/19 |
| 5,921,751 | A | 7/1999 | Freling et al. | |
| 6,528,189 | B1 * | 3/2003 | Beele | C23C 28/00 416/241 B |
| 8,777,562 | B2 | 7/2014 | Strock et al. | |
| 2007/0190351 | A1 * | 8/2007 | Eichmann | C23C 28/321 428/622 |
| 2007/0190352 | A1 * | 8/2007 | Bayer | C23C 8/02 428/627 |
| 2009/0293447 | A1 | 12/2009 | Roth-Fagaraseanu et al. | |
| 2010/0143108 | A1 | 6/2010 | Uihlein et al. | |
| 2010/0294263 | A1 | 11/2010 | Kuckelkorn et al. | |

FOREIGN PATENT DOCUMENTS

| | | | |
|---|---|---|---|
| EP | 2253737 | A1 | 11/2010 |
| GB | 1384883 | | 2/1975 |

* cited by examiner

FIRE CONTAINMENT COATING SYSTEM FOR TITANIUM

BACKGROUND

The disclosure relates to gas turbine engines. More particularly, the disclosure relates to fire containment coatings for titanium components.

In gas turbine engines, compression of inlet air causes a continuous temperature and pressure increase from upstream to downstream along the gaspath within the compressor section(s). Components within the compressor section(s) are typically made of lightweight alloys such as titanium alloys. Such components include disks, blade stages carried by the disks, case structure surrounding the disks, vane stages carried by the case structure between blade stages, and outer air seals carried by the case structure surrounding the blade stages.

The high temperature and air pressure within downstream portions of the compressor section(s) create a favorable environment for engine fires. Blade tip rub against outer air seals may be sufficient to ignite titanium material of the blades and/or air seals. This material may be driven into contact with the case structure. To contain fires, the inner diameter (ID) portions of the case structure may be coated with a barrier coating system similar to those used on hot section components (e.g., used on nickel-based superalloy components of combustor and turbine sections). Exemplary coatings comprise a metallic bondcoat and a ceramic barrier coating. The barrier coating provides thermal insulation. Exemplary bondcoats are MCrAlY bondcoats. Exemplary barrier coatings are zirconia-based (e.g., yttria-stabilized zirconia).

SUMMARY

One aspect of the disclosure involves a coated substrate comprising: a metallic substrate; a bondcoat atop the substrate; and a ceramic barrier coat atop the bondcoat. The bondcoat has a combined content of one or more of molybdenum, chromium, and vanadium of at least 50 percent by weight.

A further embodiment may additionally and/or alternatively include the metallic substrate being a titanium-based substrate.

A further embodiment may additionally and/or alternatively include the metallic substrate comprising aluminum and vanadium.

A further embodiment may additionally and/or alternatively include the metallic substrate being a steel substrate.

A further embodiment may additionally and/or alternatively include the bondcoat comprising by weight at least 50 weight percent said chromium.

A further embodiment may additionally and/or alternatively include the bondcoat comprising by weight at least 6.0 percent nickel.

A further embodiment may additionally and/or alternatively include the bondcoat comprising by weight at least 10.0 percent cobalt.

A further embodiment may additionally and/or alternatively include the bondcoat comprising by weight at least 50.0 percent said molybdenum and at least 6 percent nickel.

A further embodiment may additionally and/or alternatively include the bondcoat comprising by weight at least 54 weight percent said vanadium.

A further embodiment may additionally and/or alternatively include the bondcoat comprising by weight at least 6.0 weight percent aluminum.

A further embodiment may additionally and/or alternatively include the ceramic barrier coat comprising at least 50 weight percent zirconia.

A further embodiment may additionally and/or alternatively include the ceramic barrier coat comprising yttria-stabilized zirconia.

A further embodiment may additionally and/or alternatively include, at a location along the substrate, the bondcoat having a thickness of 25.4 micrometer to 0.41 millimeter and the ceramic barrier coat having a thickness of 0.10 millimeter to 1.27 millimeter.

A further embodiment may additionally and/or alternatively include the substrate having a melting point of at most 1660° C. and the bondcoat having a melting point of at least 1550° C.

A further embodiment may additionally and/or alternatively include the substrate having a melting point and the bondcoat having a melting point greater than the melting point of the substrate.

A further embodiment may additionally and/or alternatively include the substrate having a melting point and the bondcoat having a melting point at least 25° C. greater than the melting point of the substrate.

A further embodiment may additionally and/or alternatively include the coated substrate being a gas turbine engine case half wherein the bondcoat and the ceramic barrier coat are along an inner diameter (ID) surface of the case half.

A further embodiment may additionally and/or alternatively include a gas turbine engine including the coated substrate as a compressor case and further comprising: a blade outer air seal stage carried by the compressor case; and a stage of blades surrounded by the stage of blade outer air seals.

A further embodiment may additionally and/or alternatively include one or both of the blades each having a titanium alloy substrate and the blade outer air seal stage having titanium alloy substrates.

A further embodiment may additionally and/or alternatively include the bondcoat and barrier coat being on an inner diameter (ID) surface of the compressor case.

A further embodiment may additionally and/or alternatively include an inner diameter (ID) surface of the compressor case surrounding the blade outer air seal stage.

A further embodiment may additionally and/or alternatively include a method for manufacturing the coated substrate. The method comprises applying the bondcoat by air plasma spray.

A further embodiment may additionally and/or alternatively include applying the ceramic barrier coat by air plasma spray.

Another aspect of the disclosure involves a coated substrate comprising: a titanium-based substrate; a bondcoat atop the substrate; and a ceramic barrier coat atop the bondcoat. The substrate has a melting point and the bondcoat has a melting point at least 25° C. greater than the melting point of the substrate.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
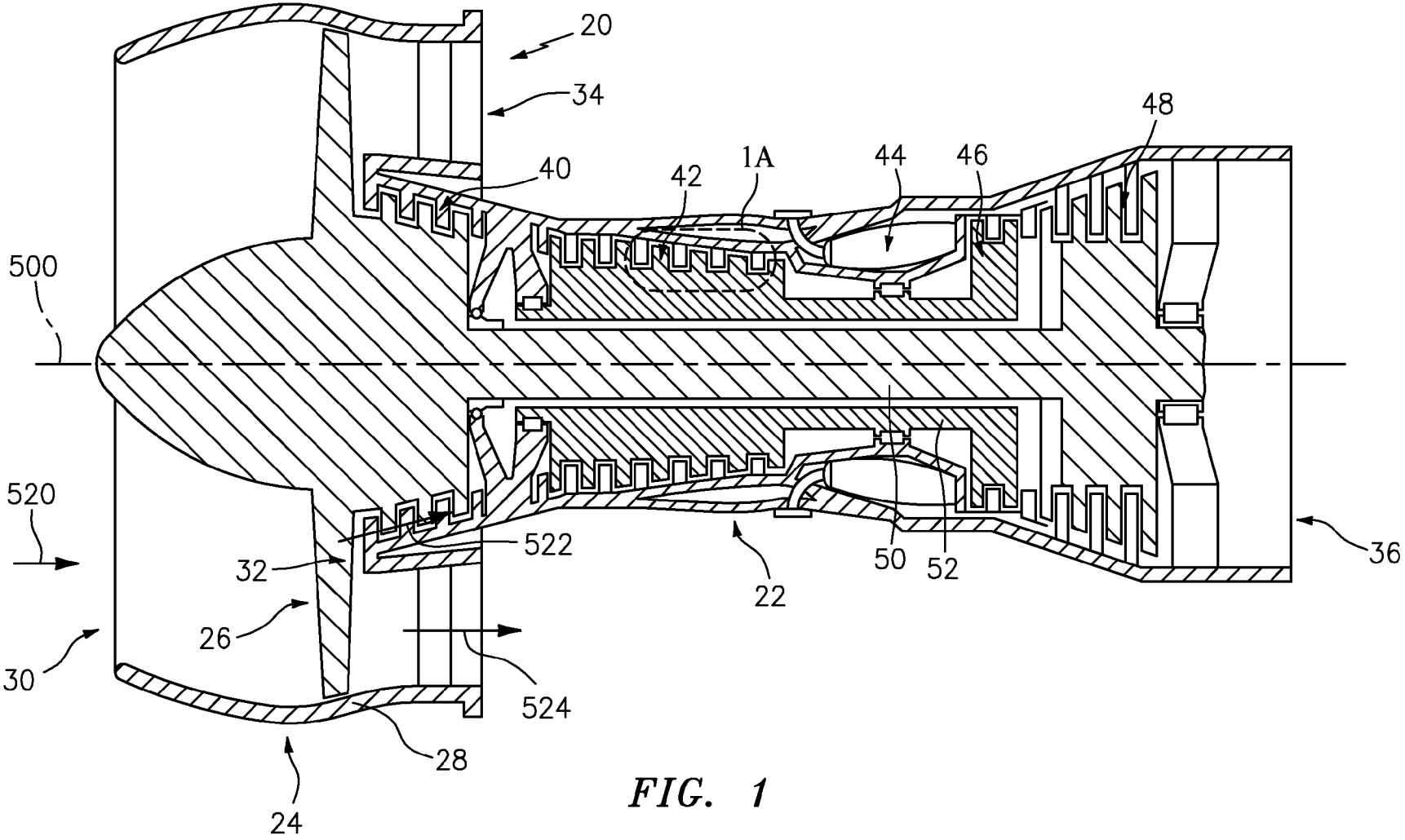
FIG. 1 is a simplified central axial sectional view of a gas turbine engine.

FIG. 1 shows a gas turbine engine 20 having an engine case 22 surrounding a centerline or central longitudinal axis 500. An exemplary gas turbine engine is a turbofan engine having a fan section 24 including a fan 26 within a fan case 28. The exemplary engine includes an inlet 30 at an upstream end of the fan case receiving an inlet flow along an inlet flowpath 520. The fan 26 has one or more stages 32 of fan blades. Downstream of the fan blades, the flowpath 520 splits into an inboard portion 522 being a core flowpath and passing through a core of the engine and an outboard portion 524 being a bypass flowpath exiting an outlet 34 of the fan case.

The core flowpath 522 proceeds downstream to an engine outlet 36 through one or more compressor sections, a combustor, and one or more turbine sections. The exemplary engine has two axial compressor sections and two axial turbine sections, although other configurations are equally applicable. From upstream to downstream there is a low pressure compressor section (LPC) 40, a high pressure compressor section (HPC) 42, a combustor section 44, a high pressure turbine section (HPT) 46, and a low pressure turbine section (LPT) 48. Each of the LPC, HPC, HPT, and LPT comprises one or more stages of blades which may be interspersed with one or more stages of stator vanes.

In the exemplary engine, the blade stages of the LPC and LPT are part of a low pressure spool mounted for rotation about the axis 500. The exemplary low pressure spool includes a shaft (low pressure shaft) 50 which couples the blade stages of the LPT to those of the LPC and allows the LPT to drive rotation of the LPC. In the exemplary engine, the shaft 50 also drives the fan. In the exemplary implementation, the fan is driven via a transmission (not shown, e.g., a fan gear drive system such as an epicyclic transmission) to allow the fan to rotate at a lower speed than the low pressure shaft.

The exemplary engine further includes a high pressure shaft 52 mounted for rotation about the axis 500 and coupling the blade stages of the HPT to those of the HPC to allow the HPT to drive rotation of the HPC. In the combustor 44, fuel is introduced to compressed air from the HPC and combusted to produce a high pressure gas which, in turn, is expanded in the turbine sections to extract energy and drive rotation of the respective turbine sections and their associated compressor sections (to provide the compressed air to the combustor) and fan.

Figure 1A:
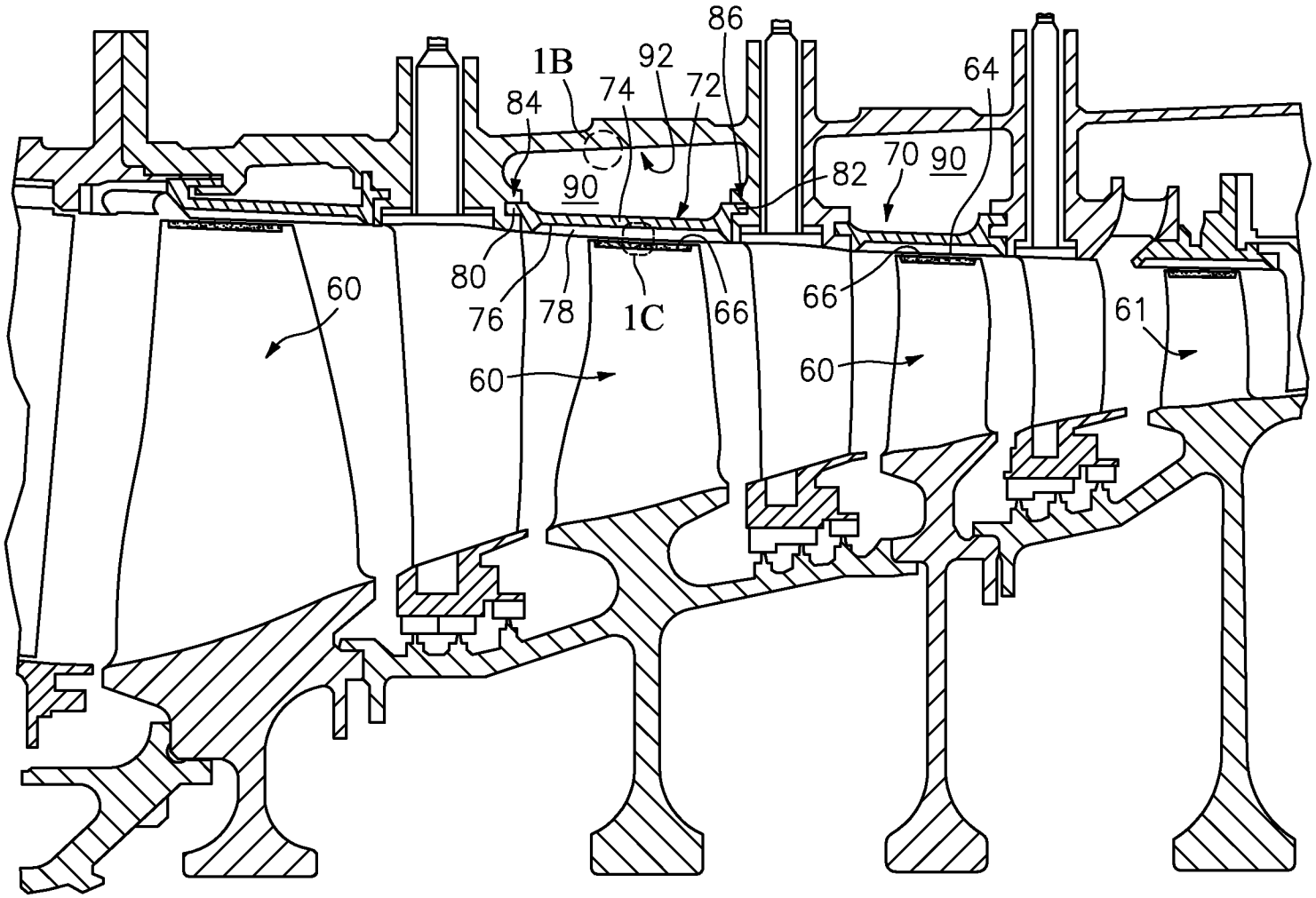
FIG. 1A is an enlarged view of a high pressure compressor (HPC) section of the engine of FIG. 1.

FIG. 1A shows sequential stages of HPC blades 60, 61 having airfoils 62 with tips 64 (e.g., abrasive-coated 66 tips). The relatively upstream stages of blades 60 have Ti-alloy substrates. The relatively downstream stage(s) of blades 61 may have Ni-alloy substrates.

The case carries air seals 70 immediately outboard of blade tips. Each stage of air seal may be associated with a respective stage of blades and may be formed in a plurality of circumferential segments 72 arrayed circumferentially end-to-end. The air seal segments may comprise metallic substrates (e.g., Ti-alloy (Ti-based as at least 50% Ti by weight), steel, or Ni-based superalloy) 74 having inner diameter (ID) surfaces 76 bearing an abradable coating 78 with the tips bearing abrasive coating 66.

The air seal segments may have features for mounting to the case. FIG. 1A shows exemplary fore and aft rails 80, 82 on the air seal segments captured in channels 84, 86 of the case. Outboard of the main body of each air seal stage, the case defines respective pockets 90 (e.g., annular pockets). A key area for fire protection is along the outboard boundary/wall 92 of the pockets (e.g., formed by the inner diameter (ID) surface of the case at the pockets). In case of fire (e.g., a burning blade) burning material may be centrifugally flung or driven by air pressure radially outward to contact such surface. Accordingly, the inner diameter (ID) surface 102 (FIG. 1B) of the case substrate 100 at the pockets is one key area for fire protective coating. However, other areas may also be relevant.

Figure 1B:
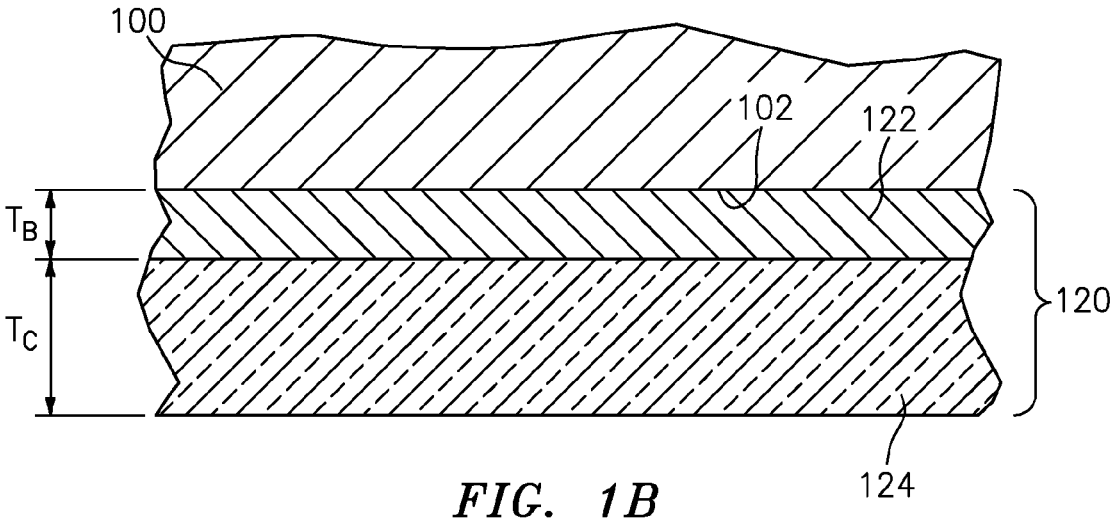
FIG. 1B is an enlarged view of a case coating along the HPC of the engine of FIG. 1.

FIG. 1B shows the ID surface 102 of the case substrate 100 along a pocket 90 bearing a coating system 120 comprising a metallic bondcoat 122 and a ceramic barrier coat 124 directly atop the bondcoat. The case will typically be both axially and circumferentially segmented. Axially there may typically be one or two segments or rings of segments just along each of the HPC and LPC sections. Circumferentially, the case or ring may be in a single piece or an exemplary two to eight segments. Thus the substrate 100 may be the substrate of such a segment. The exemplary bondcoat is a single layer of a single composition subject to minor interdiffusion (if any) with a substrate or barrier coat elements. The exemplary bondcoat has a thickness $T_B$ and the exemplary barrier coat has a thickness $T_C$. Exemplary characteristic or local bondcoat thickness $T_B$ is 1.0 mil to 16.0 mil (25.4 micrometer to 0.41 millimeter), more particularly, 4.0 mil to 8.0 mil (0.10 millimeter to 0.20 millimeter). Exemplary barrier thickness $T_C$ is 4.0 mil to 50.0 mil (0.10 millimeter to 1.27 millimeter), more particularly, 10.0 mil to 30.0 mil (0.25 millimeter to 0.76 millimeter).

With exemplary existing coatings, an observed failure mechanism has been melting of the bondcoat causing delamination of the barrier coat. To provide enhanced fire protection, the bondcoat chemistry may be chosen to have a melting point higher than typical MCrAlY bondcoat material and higher than that of the substrate. For example, an exemplary titanium alloy substrate has a melting point (solidus) of 1550° C. to 1660° C., more particularly, 1580° C. to 1630° C. A particular Ti alloy is Ti6Al4V having a melting point of 1604° C. (solidus) and 1660° C. (liquidus). Exemplary MCrAlYs have melting points (solidus) of 1200° C. to 1350° C. An exemplary baseline MCrAlY has a melting point (solidus) of 1335° C.

The exemplary bondcoat, however, may have a melting point of at least an exemplary 1455° C., more particularly, at least an exemplary 1495° C. or 1495° C. to 2617° C.

This melting point may be an exemplary at least 25° C. higher than the melting point of the case substrate, for maximum protection. Temperatures much higher are not clearly beneficial because the bondcoat will conduct heat through to the substrate and allow the substrate to melt. Thus a broader range is at least 1.0° C. or at least 10° C. higher. This may lead to the incongruity that the bondcoat used on the HPC case (or other cold section component) may have a higher melting point than one-to-all of the bondcoat materials used in the hot section.

Exemplary bondcoat materials are chromium and/or molybdenum-based alloys (e.g., at least 50 wt. % combined chromium and molybdenum content).

A first exemplary bondcoat is a chromium-nickel binary system. This exemplary system may have 95 wt. % to 100 wt. % chromium and nickel combined, more particularly, 98% to 100%. Within the chromium-nickel system, relatively high melting points are achieved with relatively high chromium contents. An exemplary range of chromium content is 50 wt. % to 100 wt. %. A narrower range is 60 wt. % to 100 wt. %. A narrower range is 76 wt. % to 94 wt. % discussed below. Some nickel content may be desired to provide improved toughness/durability (due to better ductility) and perhaps limit cost. A range of chromium content of 76 wt. % to 94 wt. % has associated melting points of about 1455° C. to about 1720° C. (estimate from phase diagrams). Within that range, alternative range endpoints include 88 wt. % yielding about a 1605° C. solidus. Pure chromium has a 1907° C. melting point. Commercially pure chromium (98 wt. % pure) has about a 1850° C. melting point.

A second exemplary bondcoat is a chromium-cobalt binary system. This exemplary system may have 95 wt. % to 100 wt. % chromium and cobalt combined, more particularly, 98% to 100%. Within the chromium-cobalt system, relatively high melting points are achieved with relatively high chromium contents. An exemplary range of chromium content is 50 wt. % to 100 wt. %. A narrower range is 67 wt. % to 90 wt. % discussed below. Some cobalt content may be desired to provide improved toughness/durability (due to better ductility) and perhaps limit cost. A range of chromium content of 67 wt. % to 90 wt. % has associated melting points of about 1495° C. to about 1730° C. Within that range, alternative range endpoints include 80 wt. % yielding about a 1605° C. solidus.

A third exemplary bondcoat is a molybdenum-nickel binary system. This exemplary system may have 95 wt. % to 100 wt. % molybdenum and nickel combined, more particularly, 98 wt. % to 100 wt. %. Within the molybdenum-nickel system, relatively high melting points are achieved with relatively high molybdenum contents. An exemplary range of molybdenum content is 50 wt. % to 100 wt. %. A narrower range is 52 wt. % to 94 wt. % discussed below. Some nickel content may be desired to provide improved toughness/durability (due to better ductility) and perhaps limit cost. A range of molybdenum content 52 wt. % to 94 wt. % has associated melting points of about 1455° C. to about 2477° C. Within that range, alternative range endpoints include 56 wt. % yielding about a 1605° C. solidus and 87 wt. % yielding about a 2327° C. solidus. Pure molybdenum has a 2617° C. melting point.

A fourth exemplary bondcoat is a vanadium-aluminum binary system. This exemplary system may have 95 wt. % to 100 wt. % vanadium and aluminum combined, more particularly, 98% to 100%. Within the vanadium-aluminum system, relatively high melting points are achieved with relatively high vanadium contents. An exemplary range of vanadium content is 54 wt. % to 100 wt. %. A narrower range is 62 wt. % to 94 wt. %. A narrower range is 74 wt. % to 91 wt. % discussed below. Some aluminum content may be desired to provide improved corrosion resistance/durability (due to formation of a protective aluminum oxide surface layer) and perhaps limit cost. There is a 1670° C. plateau in melting point from 54 wt. % to about 62 wt. %. Thus, a range of vanadium content of from anywhere between 54 wt. % and 62 wt. % on the one hand to 94 wt. % on the other hand has associated melting points of about 1670° C. to about 1900° C. A range of vanadium content of 74 wt. % to 91 wt. % has associated melting points of about 1850° C. to about 1885° C. Pure vanadium has a 1910° C. melting point. Although ranges up to near 100 wt. % may be desirable from a performance point of view, balancing costs suggests a value closer to the 74 wt. % example.

Other possibilities include using mixtures of the higher melting point elements along with relevant amounts of one or more lower melting point elements (plus impurities and minor additions typically totaling at most 2.0 wt. % or at most 5.0 wt. %). Thus tertiary or greater systems may be implemented. One example is nickel-molybdenum-chromium. In such a system, the molybdenum provides increased solidus; the chromium provides hot corrosion-resistance (via formation of surface chromium oxide film); and the nickel provides ductility. Thus, exemplary systems comprising more than one of the high melting point elements (e.g., molybdenum, chromium or vanadium) may have a total of at least 50 wt. % combined of such elements.

Exemplary bondcoat deposition is via air plasma spray. Alternative techniques include high velocity oxy-fuel (HVOF), high velocity air-fuel (HVAF), cold spray, warm spray, electron beam physical vapor deposition (EBPVD), and cathodic arc deposition.

Exemplary barrier coating may be of conventional thermal barrier coating (TBC) composition. Key examples are zirconias such as yttria-stabilized zirconia (YSZ), gadolinia-stabilized zirconia (GSZ), and mixtures thereof or layered combinations thereof and the like. A basic example is a 7 wt. % yttria-stabilized zirconia (7YSZ). This may be applied by air plasma spray or by various techniques mentioned above for the bondcoat.

Another example is a segmented outer air seal. Although Ti-based substrates are noted above for these (see, also, U.S. Pat. No. 8,777,562 (the disclosure of which is incorporated by reference in its entirety herein as if set forth at length) which discloses a Ti-based substrate with metallic bondcoat and ceramic topcoat forming a thermal barrier and then a metallic abradable atop the ceramic), steel is an alternate substrate. Fire is more significant when Ti-based segments are involved because the Ti alloy has a greater contribution as a fuel than the steel does (thus the present bondcoats help resist ignition of such substrate). However, the present bondcoats will still have benefit in a situation involving a steel substrate.

Figure 1C:
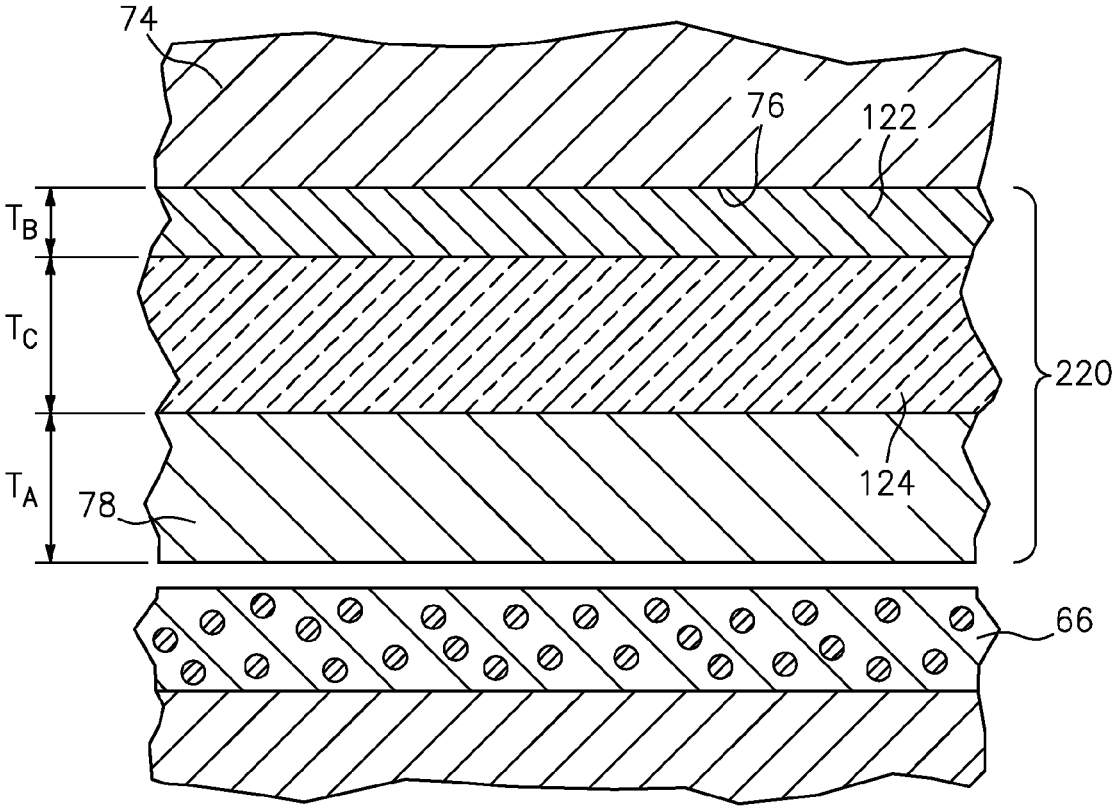
FIG. 1C is an enlarged view of an outer air seal coating along the HPC of the engine of FIG. 1.

FIG. 1C shows the ID surface 76 of the outer air seal segment substrate 74 bearing a coating system 220 comprising the metallic bondcoat 122 and ceramic barrier coat 124 directly atop the bondcoat. The abradable coating 78 (e.g., of U.S. Pat. No. 8,777,562) is atop the ceramic barrier coat and has thickness shown as $T_A$.

Exemplary steel substrate material is 400-series hardenable stainless steel having a melting point of 1477° C. (solidus, with liquidus being very slightly higher). The same ranges of bondcoat melting points may be used as noted above. When expressed in terms relative to substrate melting point, those differences will be 127° C. greater than the difference ranges specified for Ti-based substrates. Similarly, the deltas will change if nickel-based substrates are used.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

What is claimed is:

1. A coated substrate comprising:
a metallic substrate;
a bondcoat atop the substrate; and
a ceramic barrier coat atop the bondcoat,
wherein:
the bondcoat comprises by weight at least 50.0 percent said molybdenum and at least 6 percent nickel.

2. The coated substrate of claim 1 wherein:
the metallic substrate is a titanium-based substrate.

3. The coated substrate of claim 2 wherein:
the metallic substrate comprises aluminum and vanadium.

4. The coated substrate of claim 1 wherein:
the metallic substrate is a steel substrate.

5. The coated substrate of claim 1 wherein:
the ceramic barrier coat comprises at least 50 weight percent zirconia.

6. The coated substrate of claim 1 wherein:
the ceramic barrier coat comprises yttria-stabilized zirconia.

7. The coated substrate of claim 1 wherein at a location along the substrate:
the bondcoat has a thickness of 25.4 micrometer to 0.41 millimeter; and
the ceramic barrier coat has a thickness of 0.10 millimeter to 1.27 millimeter.

8. The coated substrate of claim 1 wherein:
the substrate has a melting point of at most 1660° C.; and
the bondcoat has a melting point of at least 1550° C.

9. The coated substrate of claim 1 wherein:
the substrate has a melting point; and
the bondcoat has a melting point greater than the melting point of the substrate.

10. The coated substrate of claim 1 wherein:
the substrate has a melting point; and
the bondcoat has a melting point at least 25° C. greater than the melting point of the substrate.

11. A method for manufacturing the coated substrate of claim 1, the method comprising:
applying the bondcoat by air plasma spray.

12. The method of claim 11 further comprising:
applying the ceramic barrier coat by air plasma spray.

13. A coated substrate comprising:
a metallic substrate;
a bondcoat atop the substrate; and
a ceramic barrier coat atop the bondcoat,
wherein:
the bondcoat comprises by weight at least 54 weight percent vanadium.

14. The coated substrate of claim 13 wherein:
the bondcoat comprises by weight at least 6.0 weight percent aluminum.

15. A gas turbine engine case half comprising:
a metallic substrate;
a bondcoat atop the substrate; and
a ceramic barrier coat atop the bondcoat,
wherein:
the bondcoat has a combined content of one or more of molybdenum, chromium, and vanadium of at least 50 percent by weight; and
the bondcoat and the ceramic barrier coat are along an inner diameter (ID) surface of the case half.

16. A gas turbine engine comprising:
a compressor case comprising:
a metallic substrate;
a bondcoat atop the substrate; and
a ceramic barrier coat atop the bondcoat, wherein the bondcoat has a combined content of one or more of molybdenum, chromium, and vanadium of at least 50 percent by weight;
a blade outer air seal stage carried by the compressor case; and
a stage of blades surrounded by the stage of blade outer air seals.

17. The gas turbine engine of claim 16 wherein one or both of:
the blades each have a titanium alloy substrate; and
the blade outer air seal stage has titanium alloy substrates.

18. The gas turbine engine of claim 16 wherein:
the bondcoat and barrier coat are on an inner diameter (ID) surface of the compressor case.

19. The gas turbine engine of claim 18 wherein:
an inner diameter (ID) surface of the compressor case surrounds the blade outer air seal stage.

20. The gas turbine engine of claim 16 wherein:
the bondcoat comprises by weight at least 50 weight percent said chromium.

21. The gas turbine engine of claim 16 wherein:
the bondcoat comprises by weight at least 6.0 percent nickel.

22. The gas turbine engine of claim 16 wherein:
the bondcoat comprises by weight at least 10.0 percent cobalt.

23. The gas turbine engine of claim 16 wherein:
the metallic substrate is a titanium-based substrate.

* * * * *